US008872858B2

(12) United States Patent
Shin et al.

(10) Patent No.: US 8,872,858 B2
(45) Date of Patent: Oct. 28, 2014

(54) METHOD OF DRIVING DISPLAY PANEL AND DISPLAY APPARATUS FOR PERFORMING THE SAME

(75) Inventors: Yong-Hwan Shin, Yongin-si (KR); Min-Sik Jung, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 486 days.

(21) Appl. No.: 12/969,837

(22) Filed: Dec. 16, 2010

(65) Prior Publication Data

US 2012/0007894 A1 Jan. 12, 2012

(30) Foreign Application Priority Data

Jul. 9, 2010 (KR) ..... 10-2010-0066481

(51) Int. Cl.
*G09G 5/10* (2006.01)
*G09G 3/36* (2006.01)

(52) U.S. Cl.
CPC ..... *G09G 3/3648* (2013.01); *G09G 2320/0257* (2013.01); *G09G 2320/0276* (2013.01)
USPC ..... 345/690; 345/89; 358/479; 702/108

(58) Field of Classification Search
CPC ..... G09G 3/3648; G09G 2320/0673; G09G 2320/0276
USPC ..... 345/690
See application file for complete search history.

(56) References Cited

U.S. PATENT DOCUMENTS

2003/0055591 A1* 3/2003 Whittington et al. ..... 702/108
2004/0246537 A1* 12/2004 Ohyama et al. ..... 358/479
2007/0070008 A1* 3/2007 Shin et al. ..... 345/89
2009/0244109 A1* 10/2009 Chen et al. ..... 345/690
2011/0069096 A1* 3/2011 Li et al. ..... 345/690
2011/0221760 A1* 9/2011 Irie et al. ..... 345/589

FOREIGN PATENT DOCUMENTS

KR 20070015695 2/2007
KR 20080028178 3/2008
KR 20090053387 5/2009
WO WO 2010073775 A1 * 7/2010 ..... G09G 5/02

OTHER PUBLICATIONS

English Abstract for Publication No. KR20070015695.
English Abstract for Publication No. KR20080028178.
English Abstract for Publication No. KR20090053387.

* cited by examiner

*Primary Examiner* — Amare Mengistu
*Assistant Examiner* — Gloryvid Figueroa-Gibson
(74) *Attorney, Agent, or Firm* — F. Chau & Associates, LLC

(57) ABSTRACT

A method of driving a display panel includes generating a high pixel gamma voltage and a low pixel gamma voltage. At least one of the high pixel gamma voltage and the low pixel gamma voltage includes a positive gamma voltage and a negative gamma voltage having different values. The positive gamma voltage is a difference between a first gamma voltage higher than a common voltage and the common voltage. The negative gamma voltage is a difference between the common voltage and a second gamma voltage lower than the common voltage. A high pixel data voltage is generated based on the high pixel gamma voltage and the high pixel data voltage output to a high pixel. A low pixel data voltage is generated based on the low pixel gamma voltage and the low pixel data voltage is output to a low pixel.

2 Claims, 13 Drawing Sheets

| GRAYSCALE | HIGH PIXEL GRAYSCALE | LOW PIXEL GRAYSCALE |
|---|---|---|
| G1 | GH1 | GL1 |
| G2 | GH2 | GL2 |
| ⋮ | ⋮ | ⋮ |

| GRAYSCALE | HIGH PIXEL GRAYSCALE | LOW PIXEL POSITIVE GRAYSCALE | LOW PIXEL NEGATIVE GRAYSCALE |
|---|---|---|---|
| G1 | GH1 | GLP1 | GLN1 |
| G2 | GH2 | GLP2 | GLN2 |
| ⋮ | ⋮ | ⋮ | ⋮ |

| GRAYSCALE | HIGH PIXEL POSITIVE GRAYSCALE | HIGH PIXEL NEGATIVE GRAYSCALE | LOW PIXEL GRAYSCALE |
|---|---|---|---|
| G1 | GHP1 | GHN1 | GL1 |
| G2 | GHP2 | GHN1 | GL2 |
| ⋮ | ⋮ | ⋮ | ⋮ |

| GRAYSCALE | HIGH PIXEL POSITIVE GRAYSCALE | HIGH PIXEL NEGATIVE GRAYSCALE | LOW PIXEL POSITIVE GRAYSCALE | LOW PIXEL NEGATIVE GRAYSCALE |
|---|---|---|---|---|
| G1 | GHP1 | GHN1 | GLP1 | GLN1 |
| G2 | GHP2 | GHN1 | GLP2 | GLN2 |
| . | . | . | . | . |
| . | . | . | . | . |
| . | . | . | . | . |

METHOD OF DRIVING DISPLAY PANEL AND DISPLAY APPARATUS FOR PERFORMING THE SAME

PRIORITY STATEMENT

This application claims priority under 35 U.S.C. §119 from Korean Patent Application No. 2010-66481, filed on Jul. 9, 2010 in the Korean Intellectual Property Office (KIPO), the contents of which are herein incorporated by reference in their entirety.

BACKGROUND OF THE INVENTION

1. Field of the Invention

Exemplary embodiments of the present invention are directed to a method of driving a display panel and a display apparatus for performing the method. More particularly, exemplary embodiments of the present invention are directed to a method of driving a display panel for reducing an afterimage and a display apparatus for performing the method.

2. Description of the Related Art

In general, a liquid crystal display (LCD) apparatus includes a first substrate including a pixel electrode, a second substrate including a common electrode and a liquid crystal layer disposed between the first and second substrates. An electric field is generated by voltages applied to the pixel electrode and the common electrode. By adjusting an intensity of the electric field, the transmittance of light passing through the liquid crystal layer may be adjusted so that a desired image may be displayed.

Although an LCD apparatus may be thin, an LCD apparatus may have a narrow viewing angle. To improve the viewing angle, an LCD panel having a patterned vertical alignment (PVA) mode or a super patterned vertical alignment (S-PVA) mode has been developed.

An LCD panel having an S-PVA mode includes two subpixels having different grayscales in a unit pixel. Different voltages are respectively applied to the subpixels to provide a side grayscale band or a grayscale inversion and improve a side visibility.

However, the two subpixels in the S-PVA mode, known as a high pixel and a low pixel, have different gamma voltages, and have different kickback voltages between the high pixel and the low pixel. Due to the difference between the kickback voltages, there are different optimal common voltages between the high pixel and the low pixel. Due to the difference between the optimal common voltages, an afterimage may be generated, thereby deteriorating a display image.

SUMMARY OF THE INVENTION

Exemplary embodiments of the present invention provide a method of driving a display panel capable of reducing an afterimage.

Exemplary embodiments of the present invention also provide a display apparatus for performing the above-mentioned method.

In an exemplary method of driving a display panel according to the present invention, a high pixel gamma voltage and a low pixel gamma voltage are generated where at least one of the high pixel gamma voltage and the low pixel gamma voltage has a positive gamma voltage and a negative gamma voltage having different voltage values for the same grayscale. The positive gamma voltage is a difference between a first gamma voltage higher than a common voltage and the common voltage. The negative gamma voltage is a difference between the common voltage and a second gamma voltage lower than the common voltage. A high pixel data voltage is generated based on the high pixel gamma voltage and outputted to a high pixel. A low pixel data voltage is generated based on the low pixel gamma voltage and outputted to a low pixel.

In an exemplary embodiment, generating the gamma voltage includes converting a grayscale of a data signal into a high pixel grayscale and a low pixel grayscale using a lookup table that includes information on the high pixel grayscale and the low pixel grayscale corresponding to the grayscale of the data signal.

In an exemplary embodiment, generating the gamma voltage may further include generating the high pixel gamma voltage using the high pixel grayscale, and generating the low pixel gamma voltage using the low pixel grayscale. The high pixel gamma voltage and the low pixel gamma voltage may be generated using gamma voltage curves having different gamma voltages different for the same grayscale.

In an exemplary embodiment, a low pixel gamma voltage curve may be disposed over a high pixel gamma voltage curve for the same grayscale.

In an exemplary embodiment, the common voltage may be set to an optimal common voltage of the high pixel. A low pixel positive gamma voltage may be higher than a low pixel negative gamma voltage.

In an exemplary embodiment, the common voltage may be set to an optimal common voltage of the low pixel. A high pixel positive gamma voltage may be lower than a high pixel negative gamma voltage.

In an exemplary embodiment, the common voltage may be set to a value between an optimal common voltage of the high pixel and an optimal common voltage of the low pixel. A low pixel positive gamma voltage may be higher than a low pixel negative gamma voltage. A high pixel positive gamma voltage may be lower than a high pixel negative gamma voltage.

In an exemplary embodiment, generating the gamma voltage may further comprise converting a grayscale of a data signal into a high pixel grayscale and a low pixel grayscale using a lookup table that includes information on the high pixel grayscale and the low pixel grayscale corresponding to the grayscale of the data signal. At least one of the high pixel grayscale and the low pixel grayscale may have a positive grayscale and a negative grayscale.

In an exemplary embodiment, the common voltage may be set to an optimal common voltage of the high pixel. The lookup table may include information on the high pixel grayscale, a low pixel positive grayscale and a low pixel negative grayscale.

In an exemplary embodiment, the low pixel positive grayscale may be greater than the low pixel negative grayscale.

In an exemplary embodiment, the common voltage may be set to an optimal common voltage of the low pixel. The lookup table may include information on a high pixel positive grayscale, a high pixel negative grayscale and the low pixel grayscale.

In an exemplary embodiment, the high pixel positive grayscale may be less than the high pixel negative grayscale.

In an exemplary embodiment, the common voltage may be set to a value between an optimal common voltage of the high pixel and an optimal common voltage of the low pixel. The lookup table may include information on a high pixel positive grayscale, a high pixel negative grayscale, a low pixel positive grayscale and a low pixel negative grayscale.

In an exemplary embodiment, the low pixel positive grayscale may be greater than the low pixel negative grayscale. The high pixel positive grayscale may be less than the high pixel negative grayscale.

In an exemplary display apparatus according to the present invention, the display apparatus includes a display panel, a gamma voltage generator and a data driver. The display panel includes a unit pixel having a high pixel and a low pixel. The high pixel is electrically connected to a first gate line and a first data line. The low pixel is electrically connected to the first gate line and a second data line adjacent and parallel to the first data line. The gamma voltage generator generates a high pixel gamma voltage and a low pixel gamma voltage where at least one of the high pixel gamma voltage and the low pixel gamma voltage has a positive gamma voltage and a negative gamma voltage having different values for the same grayscale. The positive gamma voltage is a difference between a first gamma voltage higher than a common voltage and the common voltage. The negative gamma voltage is a difference between the common voltage and a second gamma voltage lower than the common voltage. The data driver generates a high pixel data voltage based on the high pixel gamma voltage and outputs the high pixel data voltage to the first data line. The data driver generates a low pixel data voltage based on the low pixel gamma voltage and outputs the low pixel data voltage to the second data line.

In an exemplary embodiment, the gamma voltage generator may include a first gamma voltage converter generating the high pixel gamma voltage and a second gamma voltage converter generating the low pixel gamma voltage. The first gamma voltage converter and the second gamma voltage converter may use gamma voltage curves having different gamma voltages for the same grayscale.

In an exemplary embodiment, the gamma voltage generator may have a lookup table that includes information on a high pixel grayscale and a low pixel grayscale corresponding to a grayscale of a data signal. At least one of the high pixel grayscale and the low pixel grayscale may have a positive grayscale and a negative grayscale.

In an exemplary embodiment, the common voltage may be set to an optimal common voltage of the high pixel. The lookup table may include information on the high pixel grayscale, a low pixel positive grayscale and a low pixel negative grayscale.

In an exemplary embodiment, the common voltage may be set to an optimal common voltage of the low pixel. The lookup table may include information on a high pixel positive grayscale, a high pixel negative grayscale and the low pixel grayscale.

In an exemplary embodiment, the common voltage may be set to a value between an optimal common voltage of the high pixel and an optimal common voltage of the low pixel. The lookup table may include information on a high pixel positive grayscale, a high pixel negative grayscale, a low pixel positive grayscale and a low pixel negative grayscale.

According to a method of driving a display panel and a display apparatus for performing the method, a difference of optimal common voltages between the high pixel and the low pixel may be compensated where an afterimage may be reduced.

DETAILED DESCRIPTION OF THE INVENTION

Hereinafter, the present invention will be explained in detail with reference to the accompanying drawings.

Figure 1:
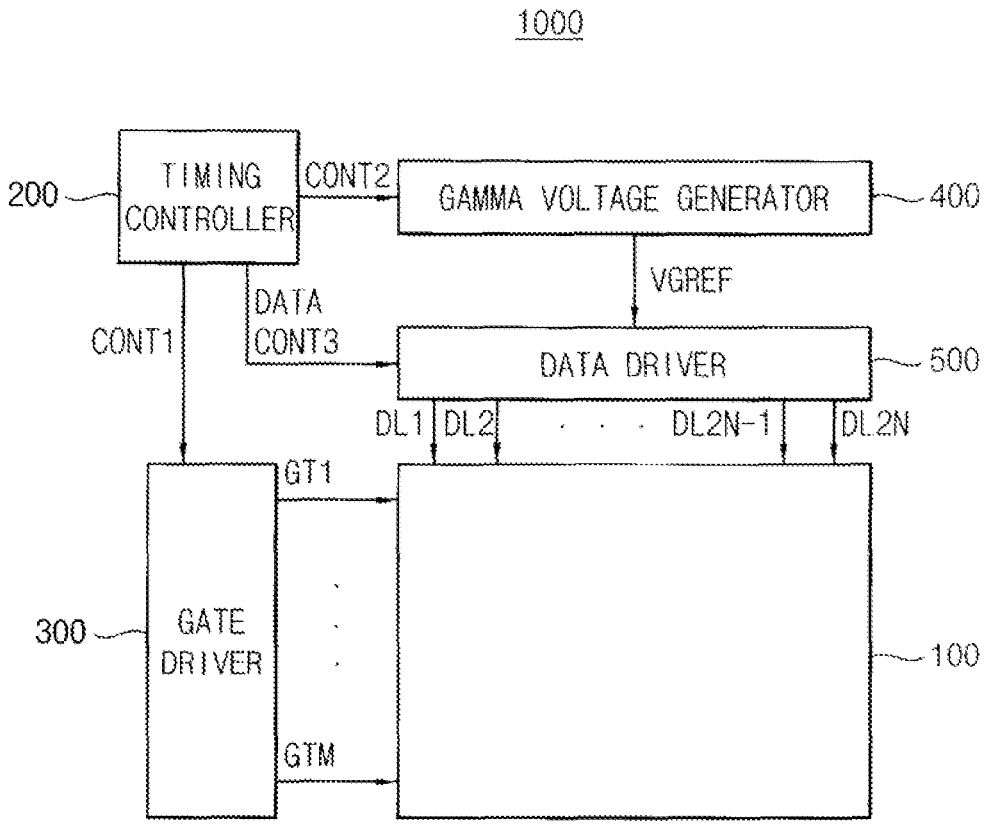
FIG. 1 is a block diagram illustrating a display apparatus according to an exemplary embodiment of the present invention.
Figure 2:
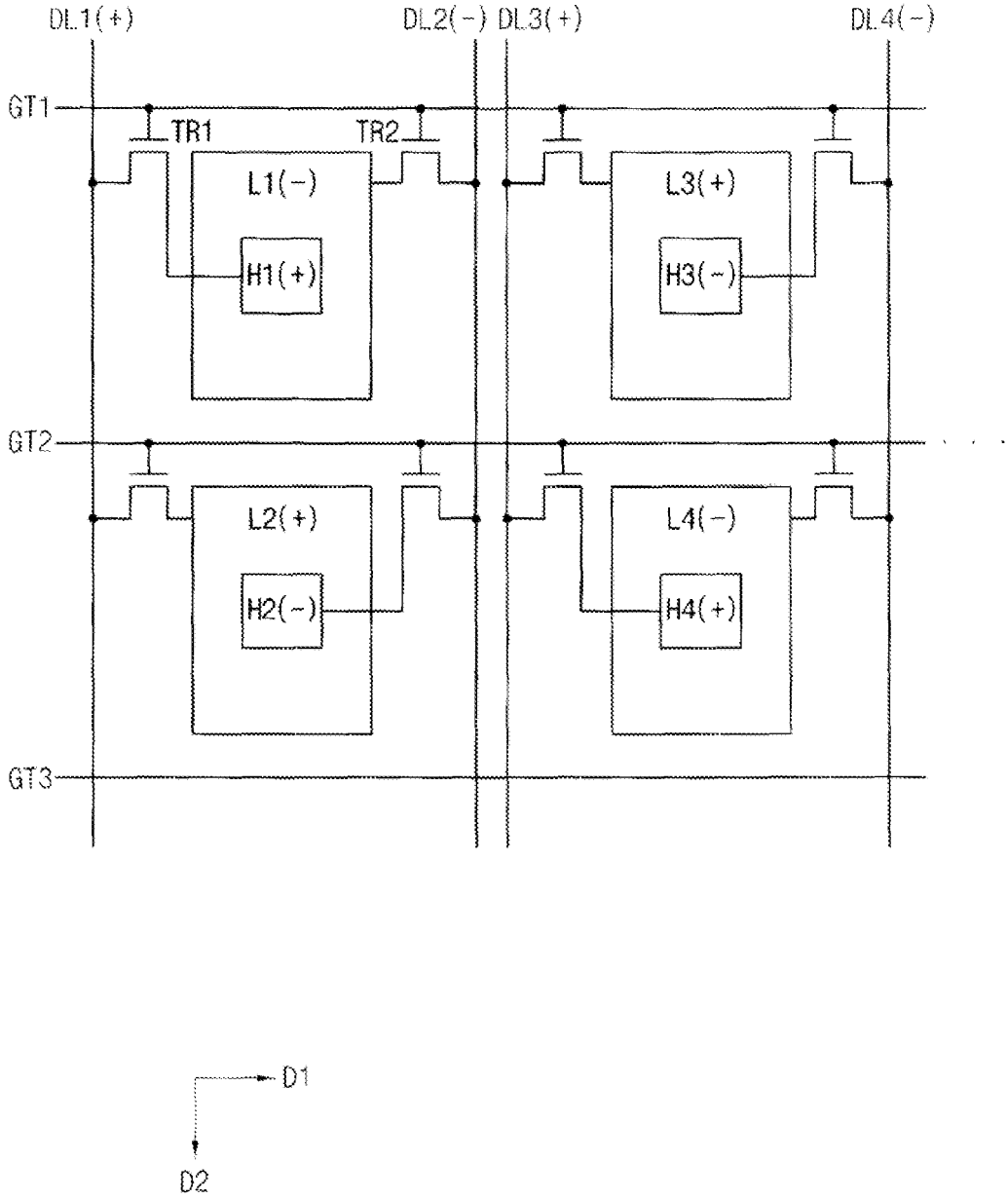
FIG. 2 is a plan view illustrating a pixel array of a display panel of FIG. 1.

FIG. 1 is a block diagram illustrating a display apparatus according to an exemplary embodiment of the present invention. FIG. 2 is a plan view illustrating a pixel array of a display panel of FIG. 1.

Referring to FIGS. 1 and 2, the display apparatus 1000 includes a display panel 100, a timing controller 200, a gate driver 300, a gamma voltage generator 400 and a data driver 500.

The display panel 100 includes a plurality of gate lines GT1 to GTM, a plurality of data lines DL1 to DL2N and a plurality of pixels. The gate lines GT1 to GTM are extended in a first direction D1, and the data lines DL1 to DL2N are extended in a second direction D2 crossing the first direction D1. Each of the pixels includes two subpixels. Each of the subpixels includes a driving element TR, and a liquid crystal capacitor and a storage capacitor electrically connected to the driving element TR. Each of the subpixels may include a high pixel and a low pixel.

The display panel 100 includes a first data line DL1, a second data line DL2 adjacent and parallel to the first data line DL1, a third data line DL3 adjacent and parallel to the second data line DL2, and a fourth data line DL4 adjacent and parallel to the third data line DL3. The display panel 100 includes a first gate line GT1, a second gate line GT2 adjacent and parallel to the first gate line GT1, and a third gate line GT3 adjacent and parallel to the second gate line GT2.

The display panel 100 includes a plurality of pixel units. Each of the pixel units includes first to fourth unit pixels. Each of the unit pixels includes one high pixel and one low pixel.

The first unit pixel includes a first high pixel H1 electrically connected to the first gate line GT1 and the first data line DL1, and a first low pixel L1 electrically connected to the first gate line GT1 and the second data line DL2. The second unit pixel is adjacent to the first unit pixel in the second direction D2. The second unit pixel includes a second high pixel H2 electrically connected to the second gate line GT2 and the second data line DL2, and a second low pixel L2 electrically connected to the second gate line GT2 and the first data line DL1. The third unit pixel is adjacent to the first unit pixel in the first direction D1. The third unit pixel includes a third high pixel H3 electrically connected to the first gate line GT1 and the fourth data line DL4, and a third low pixel L3 electrically connected to the first gate line GT1 and the third data line DL3. The fourth unit pixel is adjacent to the third unit pixel in the second direction D2. The fourth unit pixel includes a fourth high pixel H4 electrically connected to the second gate line GT2 and the third data line DL3, and a fourth low pixel L4 electrically connected to the second gate line GT2 and the fourth data line DL4.

A data voltage having a first polarity may be applied to the first and third data lines DL1 and DL3. A data voltage having a second polarity opposite to the first polarity may be applied to the second and fourth data lines DL2 and DL4. The first and second polarities may be inverted for each frame.

As a result, the display panel 100 may exhibit a dot inversion effect, that is, each pixel is inverted in the first direction D1 and the second direction D2 due to a column inversion method.

Therefore, the first to fourth high pixels H1, H2, H3 and H4 of the display panel 100 exhibit dot inversion, that is, each pixel is inverted in the first direction D1 and the second direction D2 by column inversion of the data voltage applied to the first and third data lines DL1 and DL3. The first to fourth low pixels L1, L2, L3 and L4 of the display panel 100 exhibit dot inversion, that is, each pixel is inverted in the first direction D1 and the second direction D2 by column inversion of the data voltage applied to the second and fourth data lines DL2 and DL4.

The timing controller 200 generates a first control signal CONT1, a second control signal CONT2, a third control signal CONT3 and a data signal DATA. The timing controller 200 generates the first control signal CONT1 to control the driving timing of the gate driver 300 based on an externally received control signal, and outputs the first control signal CONT1 to the gate driver 300. The timing controller 200 generates the second control signal CONT2 to generate a gamma voltage in the gamma voltage generator 400, and outputs the second control signal CONT2 to the gamma voltage generator 400. The timing controller 200 generates the third control signal CONT3 to control the driving timing of the data driver 500, and outputs the third control signal CONT3 to the data driver 500. The timing controller 200 converts an externally received input image signal into a digital data signal DATA to satisfy an operating condition of the display panel 100, and outputs the data signal DATA to the data driver 500.

The first control signal CONT1 may include a vertical start signal, a gate clock signal, and gate ON signal. The third control signal CONT3 may include a horizontal start signal, a loading signal, an inverting signal and a data clock signal.

The gate driver 300 generates gate signals to drive the gate lines GT1 to GTM in response to the first control signal CONT1 received from the timing controller 200. The gate driver 300 sequentially outputs the gate signals to the gate lines GT1 to GTM.

The gate driver 300 may be directly integrated into the display panel 100. For example, the gate driver 300 may include a plurality of thin-film transistors (TFTs) formed by the same process that forms the TFT on the pixel of the display panel 100. Alternatively, the gate driver 300 may be mounted on the display panel 100 as a chip type or a tape carrier package (TCP) type.

The gamma voltage generator 400 generates the gamma voltage VGREF in response to the second control signal CONT2. The gamma voltage generator 400 provides the gamma voltage VGREF to the data driver 500. The gamma voltage VGREF has a value corresponding to each of the data signals DATA. For example, the gamma voltage generator 400 may include a resistor string circuit. The resistor string circuit has a plurality of resistors electrically connected to each other in series, divides a source voltage and a ground voltage into the gamma voltages VGREF, and outputs the gamma voltages VGREF. The gamma voltage generator 400 may be disposed in the data driver 500.

The data driver 500 receives the third control signal CONT3 and the data signal DATA from the timing controller 200, and receives the gamma voltages VGREF from the gamma voltage generator 400. The data driver 500 converts the data signal DATA into an analog data voltage using the gamma voltages VGREF and outputs the analog data voltage to the data lines DL1 to DL2N. The data driver 500 may convert the data signal DATA into the data voltage using linear interpolation based on the gamma voltages VGREF.

Figure 3:
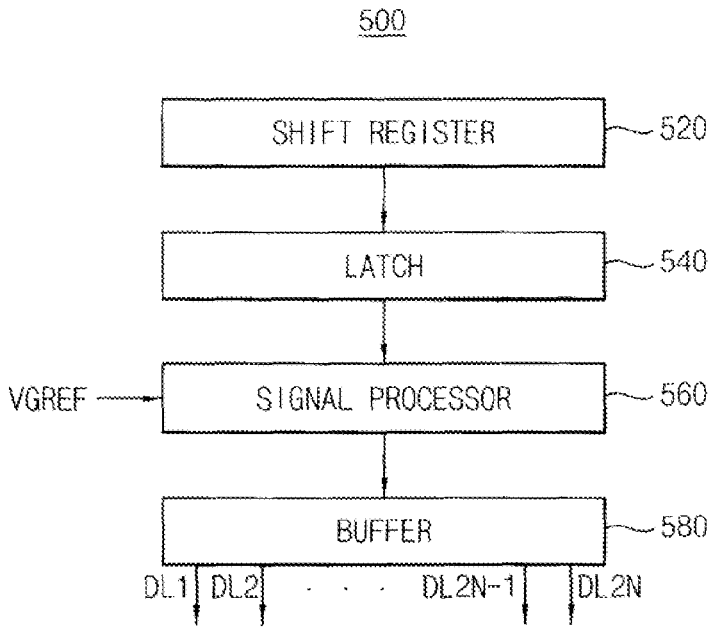
FIG. 3 is a detailed block diagram illustrating a data driver of FIG. 1.

FIG. 3 is a detailed block diagram illustrating a data driver of FIG. 1

Referring to FIGS. 1 to 3, the data driver 500 includes a shift resistor 520, a latch 540, a signal processor 560 and a buffer 580.

The shift resistor 520 outputs a latch pulse to the latch 540.

The latch 540 temporarily stores the data signals DATA, and then outputs the data signals DATA.

The signal processor 560 converts the digital data signal DATA into the analog data voltage based on the digital data signal DATA and the gamma voltages VGREF, and outputs the analog data voltage.

The buffer 580 buffers the data voltage outputted from the signal processor 560, and outputs the data voltage.

Figure 4:
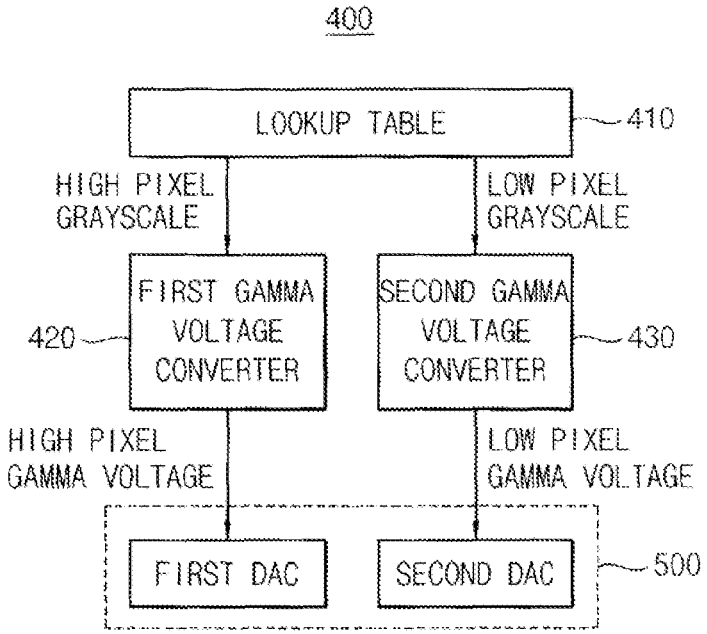
FIG. 4 is a detailed block diagram illustrating a gamma voltage generator of FIG. 1.

FIG. 4 is a detailed block diagram illustrating a gamma voltage generator of FIG. 1.

Referring to FIG. 4, the gamma voltage generator 400 includes a lookup table 410, a first gamma voltage converter 420 and a second gamma voltage converter 430.

The lookup table 410 includes information on a high pixel grayscale value and a low pixel grayscale value corresponding to a grayscale of the data signal DATA.

The first gamma voltage converter 420 generates a high pixel gamma voltage based on the high pixel grayscale value. The first gamma voltage converter 420 may provide the high pixel gamma voltage to a first digital-analog converter (DAC) of the signal processor 560 of the data driver 500.

The second gamma voltage converter 430 generates a low pixel gamma voltage based on the low pixel grayscale value. The second gamma voltage converter 430 may provide the low pixel gamma voltage to a second DAC of the signal processor 560 of the data driver 500.

Figures 5, 6:
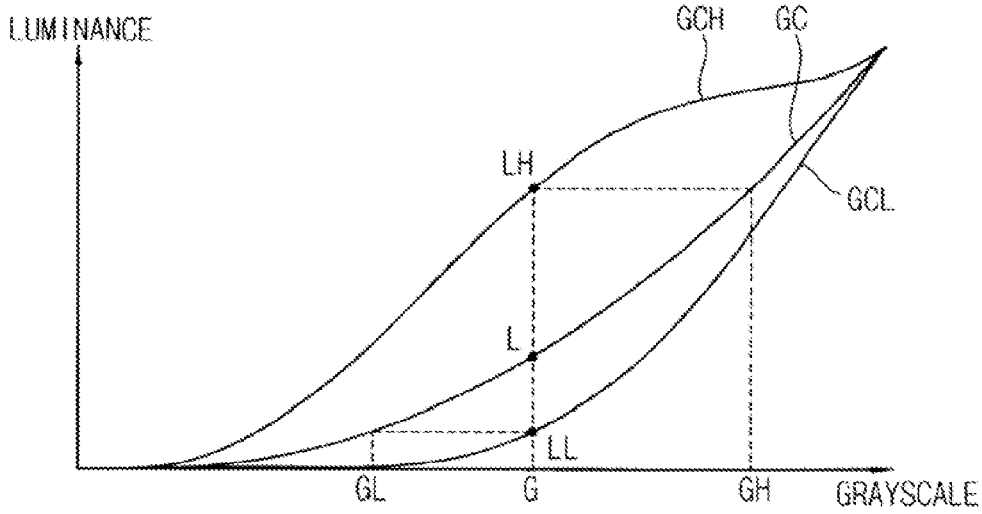
FIG. 5 is a graph of a gamma curve illustrating the gamma voltage generator of FIG. 4.
FIG. 6 is a diagram illustrating a lookup table of the gamma voltage generator of FIG. 4.
Figure 7:
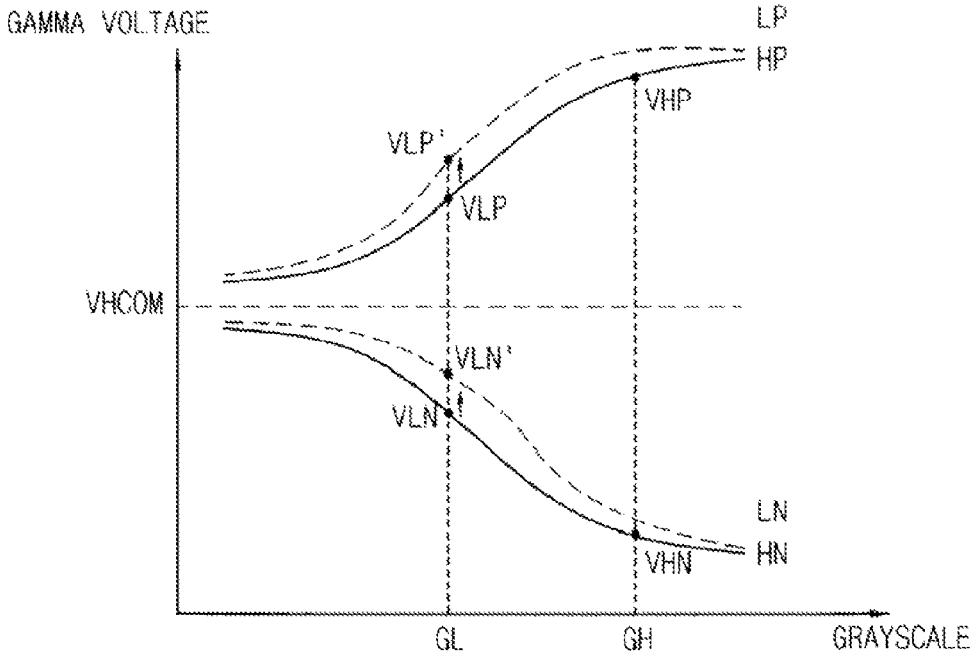
FIG. 7 is a graph of gamma voltages as functions of grayscales illustrating the gamma voltage generator of FIG. 4.

FIG. 5 is a graph of a gamma curve illustrating the gamma voltage generator of FIG. 4. FIG. 6 is a diagram illustrating a lookup table of the gamma voltage generator of FIG. 4. FIG. 7 is a graph of gamma voltages as functions of grayscales illustrating the gamma voltage generator of FIG. 4.

Hereinafter, referring to FIGS. 4 to 7, operation of the gamma voltage generator 400 is explained in detail.

Referring to FIG. 5, a gamma curve GC represents luminances of the unit pixel including both the high pixel and the low pixel, as a function of the grayscales. A high pixel gamma curve GCH represents luminances of the high pixel as a function of the grayscales. A low pixel gamma curve GCL represents luminances of the low pixel as a function of the grayscales.

For example, the luminance value displayed in a unit pixel as a function of the grayscale G may be determined to be luminance L using the gamma curve GC. However, a unit pixel according to a present exemplary embodiment includes a high pixel and a low pixel, and thus, the high pixel displays luminance LH and the low pixel displays luminance LL to display luminance L in the unit pixel.

The grayscale value of the high pixel needed to display luminance LH is grayscale GH as determined using the gamma curve GC. The grayscale value of the low pixel needed to display luminance LL is grayscale GL as determined using the gamma curve GC.

Referring to FIGS. 4 and 6, the high pixel grayscale GH and the low pixel grayscale GL corresponding to the grayscale G are stored in the lookup table 410. For example, the high pixel grayscale GH1 and the low pixel grayscale GL1 corresponding to the grayscale G1 of the display panel are stored in the lookup table 410. The high pixel grayscale GH2 and the low pixel grayscale GL2 corresponding to the grayscale G2 of the display panel are stored in the lookup table 410. The lookup table 410 may include digital values.

Referring to FIGS. 4 and 7, the gamma voltage generator 400 generates the high pixel gamma voltage and the low pixel gamma voltage using the graphs of the gamma voltages as functions of the grayscales. The gamma voltages may have a plurality of sampled values. The gamma voltages may have nine sampled values with a positive polarity and nine sampled values with a negative polarity.

Hereinafter, for simplicity, a positive gamma voltage and a negative gamma voltage are defined as follows. The positive gamma voltage is defined as a difference between a gamma voltage higher than a common voltage and the common voltage. The negative gamma voltage is defined as a difference between the common voltage and a gamma voltage lower than the common voltage.

In general, an optimal common voltage for the high pixel has a higher voltage value than the optimal common voltage for the low pixel, particularly in a middle-range grayscale. Thus, the optimal common voltages for the high pixel and the low pixel should be compensated in the middle-range grayscales.

In a present exemplary embodiment, the common voltage VCOM of the display apparatus is set to the optimal common voltage VHCOM of the high pixel.

When the common voltage VCOM of the display apparatus is the optimal common voltage VHCOM of the high pixel, the common voltage VCOM is relatively high with respect to the low pixel gamma voltages, so that the low pixel positive gamma voltage is lower than an optimal voltage for the low pixel, and the low pixel negative gamma voltage is higher than the optimal voltage for the low pixel. Thus, the low pixel positive gamma voltage and the low pixel negative gamma voltage may be compensated by increasing the low pixel gamma voltages.

Therefore, in a present exemplary embodiment, the difference of the optimal common voltages between the high pixel and the low pixel may be compensated by increasing the low pixel gamma voltages.

For example, referring to FIG. 7, when the grayscale value of a data signal is grayscale G, the high pixel grayscale value is grayscale GH. When a positive datum is applied to the high pixel, the first gamma voltage converter 420 generates high pixel gamma voltage VHP using graph HP of positive gamma voltages as functions of the grayscales. When a negative datum is applied to the high pixel, the first gamma voltage converter 420 generates high pixel gamma voltage VHN using graph HN of negative gamma voltages as functions of the grayscales.

For example, when the grayscale value of a data signal is grayscale G, the low pixel grayscale value is grayscale GL. Graphs LP and LN of the low pixel gamma voltages as functions of the grayscales are the graphs used to increase the low pixel gamma voltages. When a positive datum is applied to the low pixel, the second gamma voltage converter 430 generates low pixel gamma voltage VLP' using graph LP of positive gamma voltages as functions of the grayscales. When a negative datum is applied to the low pixel, the second gamma voltage converter 430 generates low pixel gamma voltage VLN' using graph LN of negative gamma voltages as functions of to grayscales.

Therefore, the low pixel positive gamma voltage VLP'-VHCOM is higher than the low pixel negative gamma voltage VHCOM-VLN' for the same grayscale.

Figure 8:
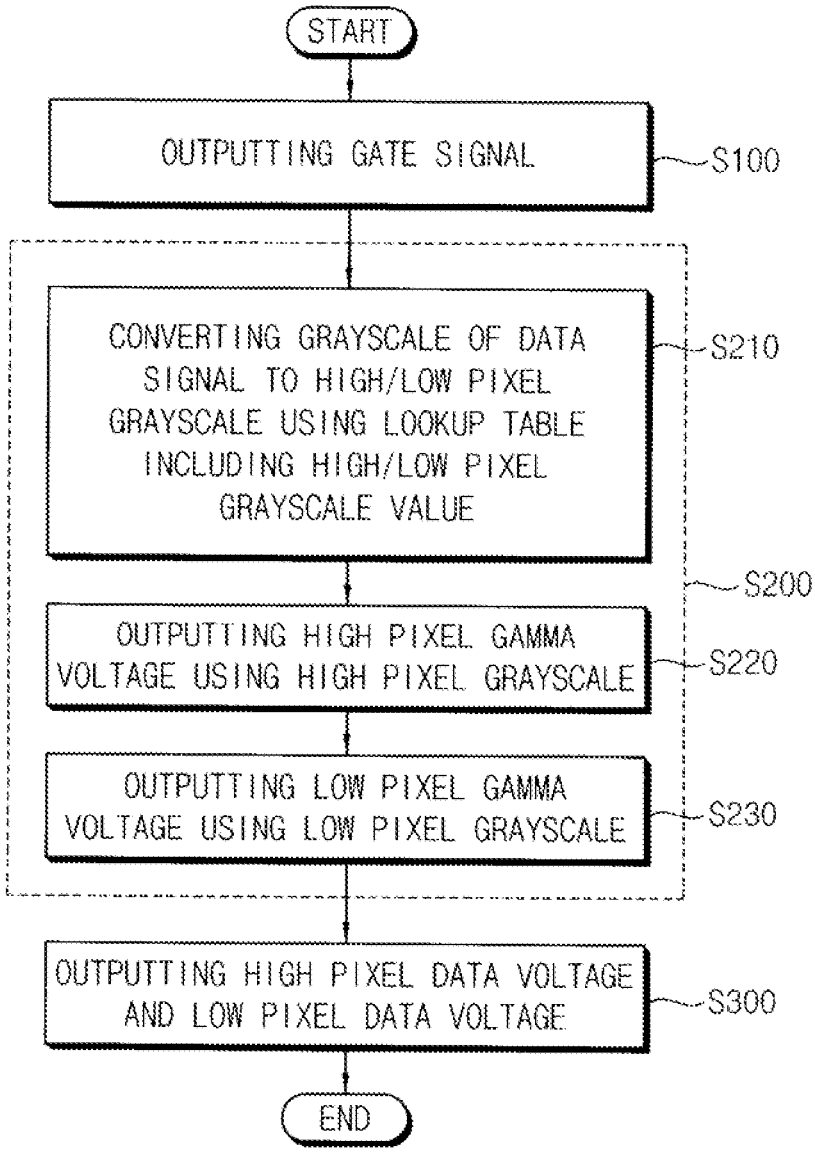
FIG. 8 is a flow chart illustrating a method of driving a display panel of FIG. 1.

FIG. 8 is a flow chart illustrating a method of driving a display panel of FIG. 1.

Hereinafter, referring to FIGS. 1, 4 and 8, the method of driving the display panel 100 according to a present exemplary embodiment is explained in detail.

The gate driver 300 generates the gate signals to drive the gate lines GT1 to GTM in response to the first control signal CONT1 received from the timing controller 200. The gate driver 300 sequentially outputs the gate signals to the gate lines GT1 to GTM (step S100).

The gamma voltage generator 400 generates the high pixel gamma voltage and the low pixel gamma voltage in response to the second control signal CONT2 received from the timing controller 200. The gamma voltage generator 400 outputs the high pixel gamma voltages and the low pixel gamma voltages to the data driver 500 (step S200).

In step S200 of generating gamma voltages, the grayscale of the data signal is converted to the high pixel grayscale and the low pixel grayscale using lookup table 410, which includes information on the high pixel grayscale value and the low pixel grayscale value corresponding to the grayscale of the data signal (step S210).

The first gamma voltage converter 420 generates the high pixel gamma voltage based on the high pixel grayscale value (step S220). The second gamma voltage converter 430 generates the low pixel gamma voltage based on the low pixel grayscale value (step S230). The high pixel gamma voltage and the low pixel gamma voltage differ from each other for the same grayscale.

The data driver 500 receives the third control signal CONT3 and the data signal DATA from the timing controller 200, and receives the high pixel gamma voltage and the low pixel gamma voltage from the gamma voltage generator 400. The data driver 500 converts the data signal DATA to an analog high pixel data voltage and an analog low pixel data voltage using the high pixel gamma voltage and the low pixel gamma voltage, and outputs the analog high pixel data voltage and the analog low pixel data voltage to the data lines DL1 to DL2N (step S300).

Figure 9:
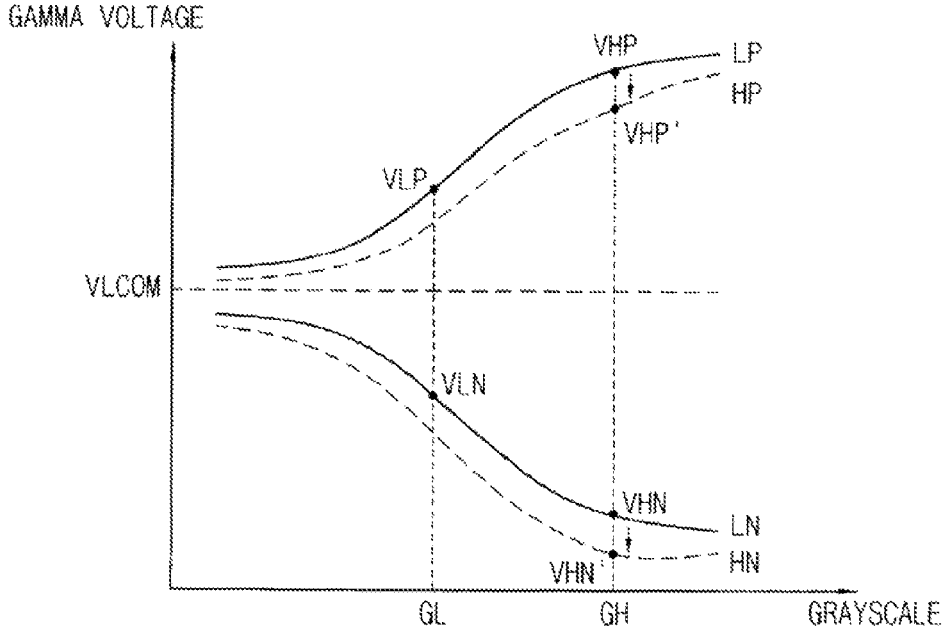
FIG. 9 is a graph of gamma voltages as functions of grayscales illustrating a gamma voltage generator of a display apparatus according to another exemplary embodiment of the present invention.

FIG. 9 is a graph of gamma voltages as functions of grayscales illustrating a gamma voltage generator of a display apparatus according to another exemplary embodiment of the present invention.

A display apparatus and method of driving a display panel of a present exemplary embodiment are substantially the same as those of a previous exemplary embodiment shown in FIGS. 1 to 8 except for graphs HP, HN, LP and LN of gamma voltages as functions of grayscales used in the first gamma voltage converter 420 and the second gamma voltage converter 430 of the gamma voltage generator 400. Thus, the same reference numerals will be used to refer to the same or like parts as those described in a previous exemplary embodiment of FIGS. 1 to 8 and any repetitive explanation concerning the above elements will be omitted.

Referring to FIGS. 4 and 9, the gamma voltage generator 400 generates the high pixel gamma voltage and the low pixel gamma voltage using the graphs of the gamma voltages as functions of the grayscales.

In a present exemplary embodiment, the common voltage VCOM of the display apparatus is set to the optimal common voltage VLCOM of the low pixel.

When the common voltage VCOM of the display apparatus is the optimal common voltage VLCOM of the low pixel, the common voltage VCOM is relatively low with respect to the high pixel gamma voltages, so that the high pixel positive gamma voltage is higher than the optimal voltage value for the high pixel and the high pixel negative gamma voltage is lower than the optimal voltage value for the high pixel. Thus, the high pixel positive gamma voltage and the high pixel negative gamma voltage may be compensated by decreasing the high pixel gamma voltages.

Therefore, in a present exemplary embodiment, the difference of the optimal common voltages between the high pixel and the low pixel may be compensated by decreasing the high pixel gamma voltages.

For example, when the grayscale value of a data signal is grayscale G, the low pixel grayscale value is grayscale GL. When a positive datum is applied to the low pixel, the second gamma voltage converter 430 generates low pixel gamma voltage VLP using graph LP of positive gamma voltages as functions of the grayscales. When a negative datum is applied to the low pixel, the second gamma voltage converter 430 generates low pixel gamma voltage VLN using graph LN of negative gamma voltages as functions of the grayscales.

For example, when the grayscale value of a data signal is grayscale G, the high pixel grayscale value is grayscale GH. Graphs HP and HN of the high pixel gamma voltages as functions of the grayscales are the graphs used to decrease the high pixel gamma voltages. When a positive datum is applied to the high pixel, the first gamma voltage converter 420 generates high pixel gamma voltage VHP' using graph HP of positive gamma voltages as functions of the grayscales. When a negative datum is applied to the high pixel, the first gamma voltage converter 420 generates high pixel gamma voltage VHN' using graph HN of negative gamma voltages as functions of the grayscales.

Therefore, the high pixel positive gamma voltage VHP'-VLCOM is lower than the high pixel negative gamma voltage VLCOM-VHN' for the same grayscale.

Figure 10:
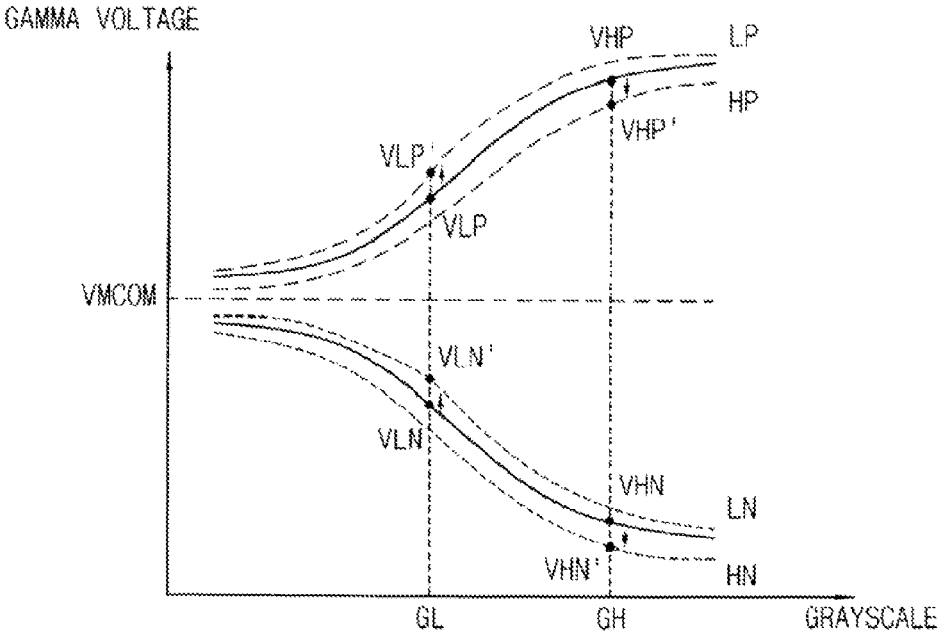
FIG. 10 is a graph of gamma voltages as functions of grayscales illustrating a gamma voltage generator of a display apparatus according to still another exemplary embodiment of the present invention.

FIG. 10 is a graph of gamma voltages as functions of grayscales illustrating a gamma voltage generator of a display apparatus according to still another exemplary embodiment of the present invention.

A display apparatus and method of driving a display panel of a present exemplary embodiment are substantially the same as those of a previous exemplary embodiment shown in FIGS. 1 to 8 except for graphs HP, HN, LP and LN of gamma voltages as functions of grayscales used in the first gamma voltage converter 420 and the second gamma voltage converter 430 of the gamma voltage generator 400. Thus, the same reference numerals will be used to refer to the same or like parts as those described in a previous exemplary embodiment of FIGS. 1 to 8 and any repetitive explanation concerning the above elements will be omitted.

Referring to FIGS. 4 and 10, the gamma voltage generator 400 generates the high pixel gamma voltage and the low pixel gamma voltage using the graphs of the gamma voltages as functions of the grayscales.

In a present exemplary embodiment, the common voltage VCOM of the display apparatus is set to a value VMCOM between the optimal common voltage VHCOM of the high pixel and the optimal common voltage VLCOM of the low pixel.

When the common voltage VCOM of the display apparatus is the value VMCOM between the optimal common voltage VHCOM of the high pixel and the optimal common voltage VLCOM of the low pixel, the common voltage VCOM is relatively high with respect to the low pixel gamma voltages, so that the low pixel positive gamma voltage is lower than the optimal voltage value for the low pixel and the low pixel negative gamma voltage is lower than the optimal voltage value for the low pixel. In addition, the common voltage VCOM is relatively low with respect to the high pixel gamma voltages, so that the high pixel positive gamma voltage is higher than the optimal voltage value for the high pixel and the high pixel negative gamma voltage is lower than the optimal voltage value for the high pixel. Thus, the low pixel positive gamma voltage and the low pixel negative gamma voltage may be compensated by increasing the low pixel gamma voltages, and the high pixel positive gamma voltage and the high pixel negative gamma voltage may be compensated by decreasing the high pixel gamma voltages.

Therefore, in a present exemplary embodiment, the difference of the optimal common voltages between the high pixel and the low pixel may be compensated by increasing the low pixel gamma voltages and decreasing the high pixel gamma voltages.

For example, when the grayscale value of a data signal is grayscale G, the high pixel grayscale value is grayscale GH. Graphs HP and HN of the high pixel gamma voltages as functions of the grayscales are the graphs used to decrease the high pixel gamma voltages. When a positive datum is applied to the high pixel, the first gamma voltage converter 420 generates high pixel gamma voltage VHP' using graph HP of positive gamma voltages as functions of the grayscales. When a negative datum is applied to the high pixel, the first gamma voltage converter 420 generates high pixel gamma voltage VHN' using graph HN of negative gamma voltages as functions of the grayscales.

For example, when the grayscale value of a data signal is grayscale G, the low pixel grayscale value is grayscale GL. Graphs LP and LN of the low pixel gamma voltages as functions of the grayscales are the graphs used to increase the low pixel gamma voltages. When a positive datum is applied to the low pixel, the second gamma voltage converter 430 generates low pixel gamma voltage VLP' using graph LP of positive gamma voltages as functions of the grayscales. When a negative datum is applied to the low pixel, the second gamma voltage converter 430 generates low pixel gamma voltage VLN' using graph LN of negative gamma voltages as functions of to the grayscales.

Therefore, the low pixel positive gamma voltage VLP'-VMCOM is higher than the low pixel negative gamma voltage VMCOM-VLN' for the same grayscale. In addition, the high pixel positive gamma voltage VHP'-VMCOM is lower than the high pixel negative gamma voltage VMCOM-VHN' for the same grayscale.

Referring to FIGS. 4 and 7 to 10, the first and second gamma voltage converters 420 and 430 generate different gamma voltages for the same grayscales. For example, graphs LP and LN of the low pixel gamma voltages as functions of the grayscales are disposed over the graphs HP and HN of the high pixel gamma voltages as functions of the grayscales, so that the low pixel data voltages are higher than the high pixel data voltages for the same grayscales in FIGS. 7, 9 and 10.

Figure 11:
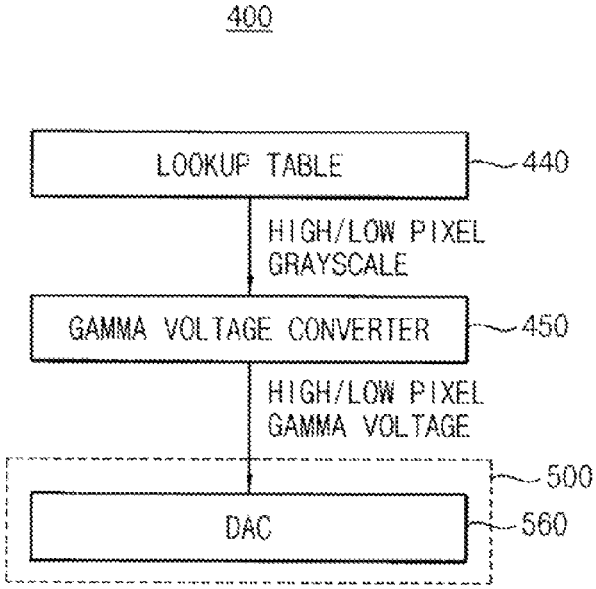
FIG. 11 is a detailed block diagram illustrating a gamma voltage generator of a display apparatus according to still another exemplary embodiment of the present invention.

FIG. 11 is a detailed block diagram illustrating a gamma voltage generator of a display apparatus according to still another exemplary embodiment of the present invention.

A display apparatus and method of driving a display panel of a present exemplary embodiment are substantially the same as those of a previous exemplary embodiment shown in FIGS. 1 to 8 except for the gamma voltage generator 400. Thus, the same reference numerals will be used to refer to the same or like parts as those described in a previous exemplary embodiment of FIGS. 1 to 8 and any repetitive explanation concerning the above elements will be omitted.

Referring to FIG. 11, the gamma voltage generator 400 includes a lookup table 440 and a gamma voltage generator 450.

The lookup table 440 includes information on a high pixel grayscale value and a low pixel grayscale value corresponding to a grayscale of the data signal DATA. The lookup table 440 according to a present exemplary embodiment is explained in detail with reference to FIG. 13.

The gamma voltage converter 450 generates a high pixel gamma voltage and a low pixel gamma voltage based on the high pixel grayscale value and the low pixel grayscale value. The gamma voltage converter 450 may be connected to the signal processor 560 of the data driver 500 to provide the gamma voltage to the signal processor 560.

Figure 12:
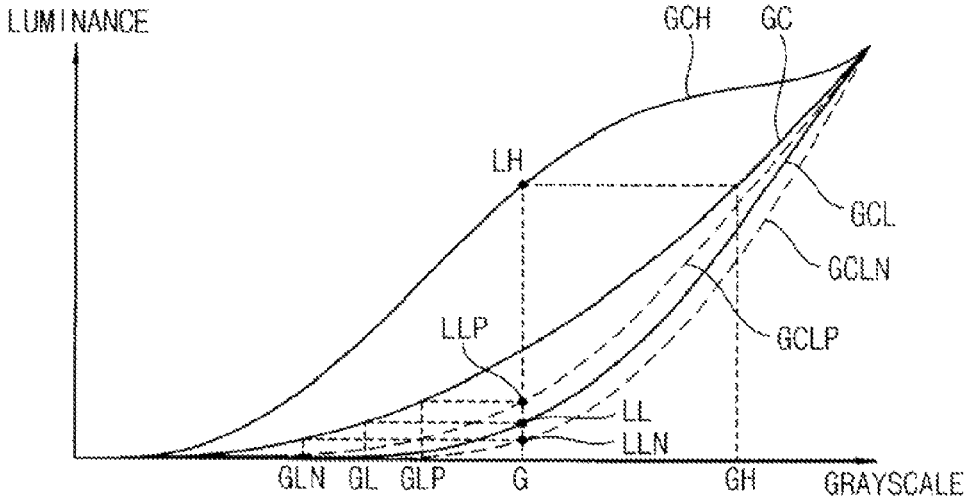
FIG. 12 is a graph of a gamma curve illustrating the gamma voltage generator of FIG. 11.
Figures 13, 14:
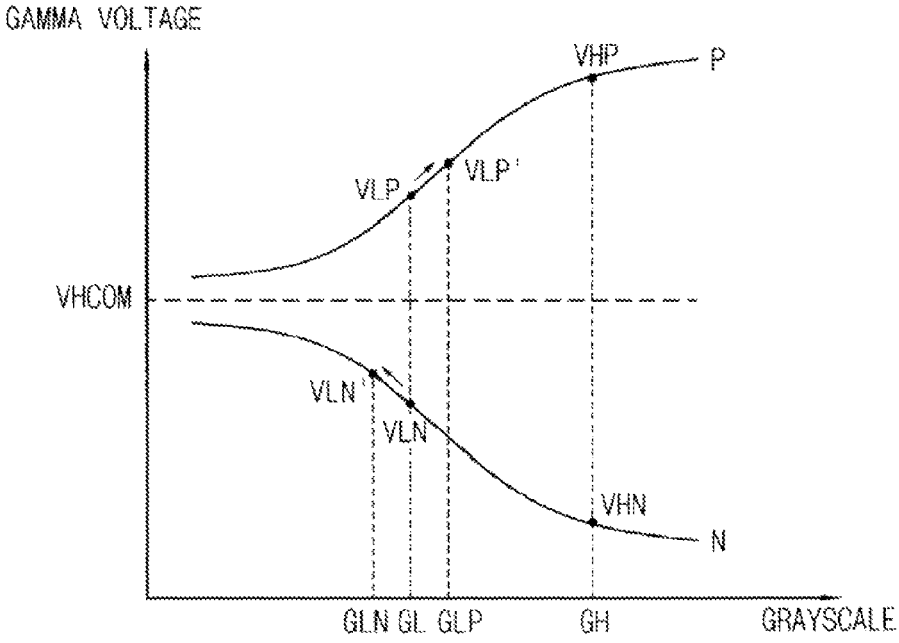
FIG. 13 is a diagram illustrating a lookup table of the gamma voltage generator of FIG. 11.
FIG. 14 is a graph of gamma voltages as functions of grayscales illustrating the gamma voltage generator of FIG. 11.

FIG. 12 is a graph of a gamma curve illustrating the gamma voltage generator of FIG. 11. FIG. 13 is a diagram illustrating a lookup table of the gamma voltage generator of FIG. 11. FIG. 14 is a graph of gamma voltages as functions of grayscales illustrating the gamma voltage generator of FIG. 11.

Hereinafter, referring to FIGS. 11 to 14, operation of the gamma voltage generator 400 of a present invention is explained in detail.

In a present exemplary embodiment, the common voltage VCOM of the display apparatus is set to the optimal common voltage VHCOM of the high pixel. Therefore, the difference of the optimal common voltages between the high pixel and the low pixel may be compensated by increasing the low pixel gamma voltages.

Referring to FIG. 12, gamma curve GC represents luminance of a unit pixel, which includes both the high pixel and the low pixel, as functions of the grayscales. High pixel gamma curve GCH represents the luminances of the high pixel as functions of the grayscales. Low pixel gamma curve GCL represents the luminances of the low pixel as functions of the grayscales.

A low pixel positive gamma curve GCLP and a low pixel negative gamma curve GCLN are used to increase the low pixel gamma voltages.

Low pixel positive gamma curve GCLP represents the luminances of the low pixel corresponding to the positive grayscales. Low pixel negative gamma curve GCLN represents the luminances of the low pixel corresponding to the negative grayscales.

For example, according to grayscale G, the high pixel displays luminance LH, the low pixel displays luminance LLP which is higher than luminance LL when the data signal is positive, and the low pixel displays luminance LLN which is lower than luminance LL when the data signal is negative.

The grayscale value of the high pixel needed to display luminance LH is grayscale GH determined using the gamma curve GC. The low pixel positive grayscale value needed to display the luminance LLP is grayscale GLP determined using the gamma curve GC. The low pixel negative grayscale value needed to display luminance LLN is grayscale GLN determined using the gamma curve GC.

The low pixel positive grayscale GLP is greater than low pixel grayscale GL, and the low pixel negative grayscale GLN is less than low pixel grayscale GL. Thus, low pixel positive grayscale GLP is greater than low pixel negative grayscale GLN.

Referring to FIGS. 11 and 13, high pixel grayscale GH, low pixel positive grayscale GLP and low pixel negative grayscale GLN corresponding to grayscale G are stored in the lookup table 440. For example, high pixel grayscale GH1, low pixel positive grayscale GLP1 and low pixel negative grayscale GLN1 corresponding to grayscale G1 are stored in the lookup table 440. Similarly, high pixel grayscale GH2, low pixel positive grayscale GLP2 and low pixel negative grayscale GLN2 corresponding to grayscale G2 are stored in the lookup table 440.

Referring to FIGS. 11 and 14, the gamma voltage generator 400 generates the high pixel gamma voltage and the low pixel gamma voltage using graphs P and N of the gamma voltages as functions of the grayscales.

For example, when the grayscale value of a data signal is grayscale G, the high pixel grayscale value is grayscale GH. When a positive datum is applied to the high pixel, the gamma voltage converter 450 generates high pixel gamma voltage VHP using graph P of positive gamma voltages as functions of the grayscales. When a negative datum is applied to the high pixel, the gamma voltage converter 450 generates high pixel gamma voltage VHN using graph N of negative gamma voltages as functions of the grayscales.

For example, when the grayscale value of a data signal is grayscale G and a positive datum is applied to the low pixel, the low pixel positive grayscale value is grayscale GLP. The gamma voltage generator 450 generates low pixel gamma voltage VLP' using graph P of the positive gamma voltages as functions of the grayscales. When the grayscale value of a data signal is grayscale G and a negative datum is applied to the low pixel, the low pixel negative grayscale value is grayscale GLN. The gamma voltage generator 450 generates low pixel gamma voltage VLN' using graph N of the negative gamma voltages as functions of the grayscales.

Therefore, the low pixel positive gamma voltage VLP'-VHCOM is higher than the low pixel negative gamma voltage VHCOM-VLN' for the same grayscale.

Figure 15:
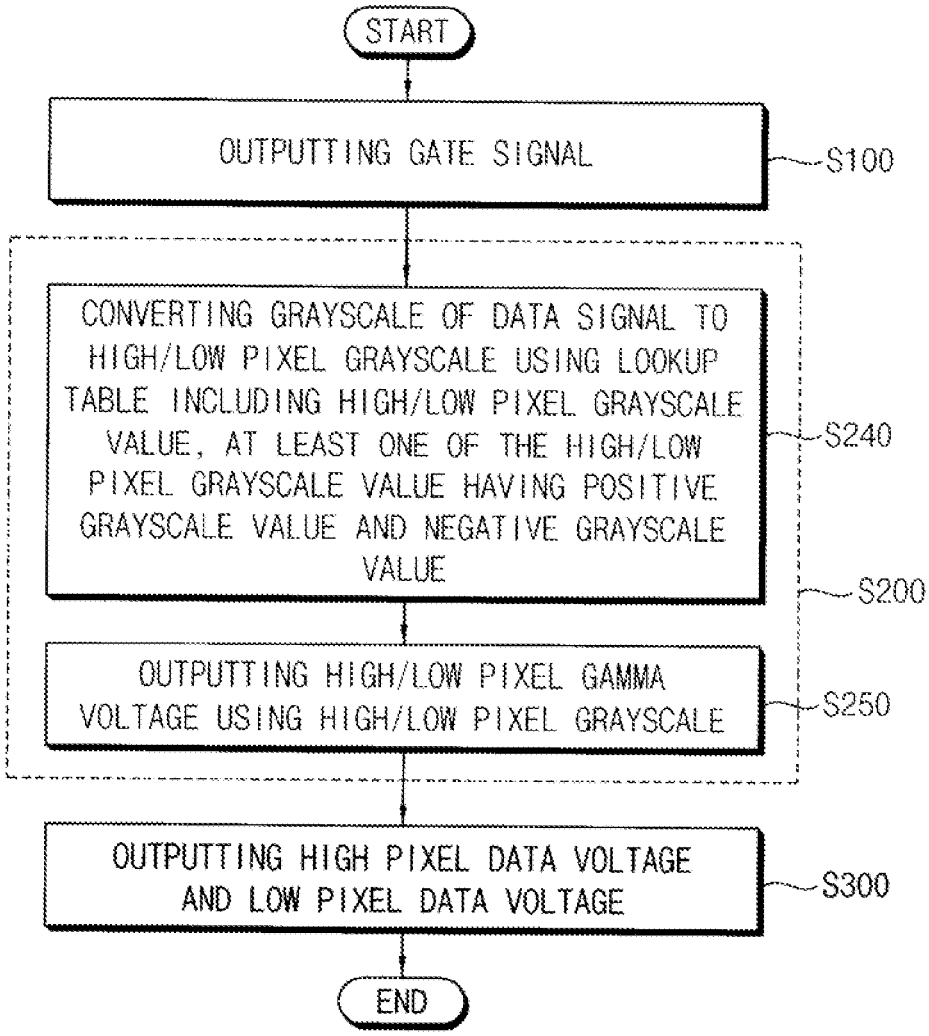
FIG. 15 is a flow chart illustrating a method of driving a display panel of a present exemplary embodiment.

FIG. 15 is a flow chart illustrating a method of driving a display panel of a present exemplary embodiment.

Hereinafter, referring to FIGS. 1, 11 and 15, the method of generating the gamma voltage according to a present exemplary embodiment is explained in detail.

The gamma voltage generator 400 generates the high pixel gamma voltage and the low pixel gamma voltage in response to the second control signal CONT2. The gamma voltage generator 400 outputs the high pixel gamma voltage and the low pixel gamma voltage to the data driver 500 (step S200).

In step S200 of generating the gamma voltages, the grayscale of the data signal is converted to the high pixel grayscale, the low pixel positive grayscale and the low pixel negative grayscale using lookup table 440, which includes information on the high pixel grayscale values, the low pixel positive grayscale values and the low pixel negative grayscale values corresponding to the grayscale of the data signal (step S240).

The gamma voltage converter 450 generates the high pixel gamma voltage based on the high pixel grayscale value and generates the low pixel gamma voltage based on the low pixel positive grayscale value and the low pixel negative grayscale value (step S250).

Figures 16, 17:
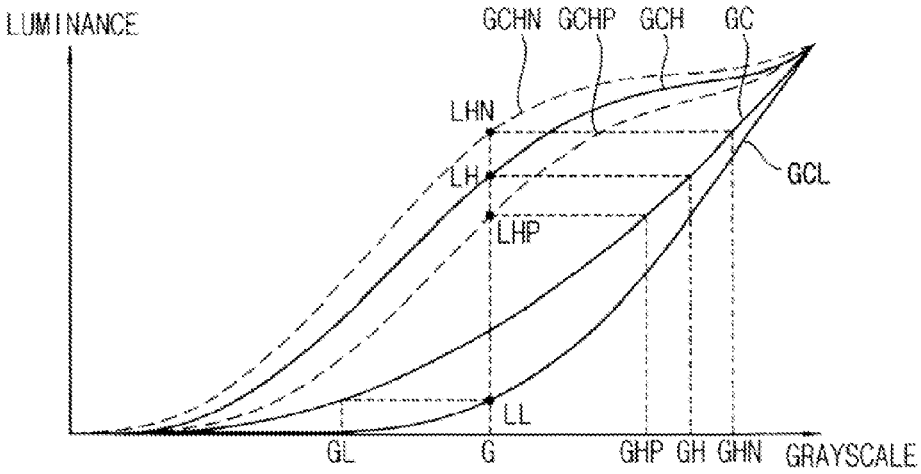
FIG. 16 is a graph of a gamma curve illustrating a gamma voltage generator of a display apparatus according to still another exemplary embodiment of the present invention.
FIG. 17 is a diagram illustrating a lookup table of the gamma voltage generator of a present exemplary embodiment.
Figure 18:
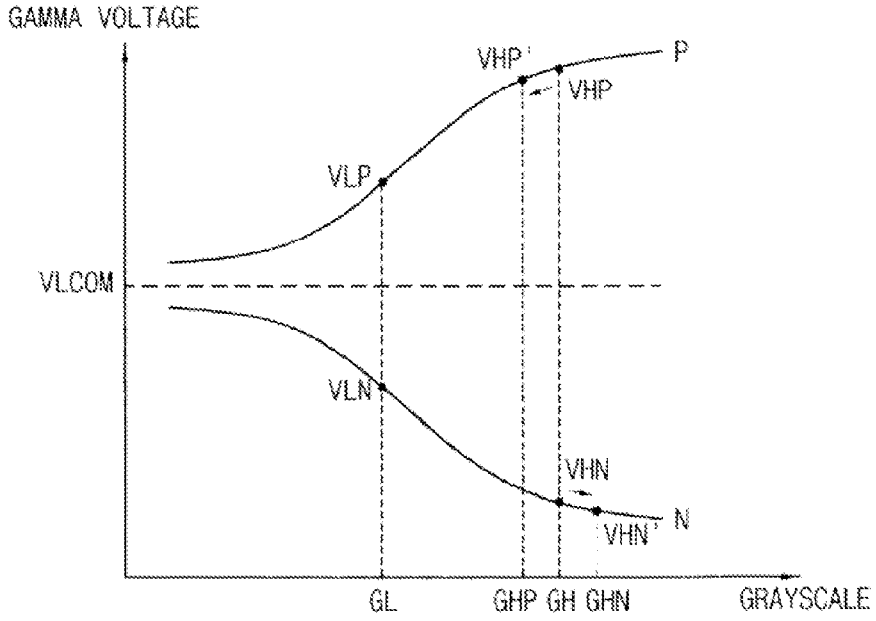
FIG. 18 is a graph of gamma voltages as functions of grayscales illustrating the gamma voltage generator of a present exemplary embodiment.

FIG. 16 is a graph of a gamma curve illustrating a gamma voltage generator of a display apparatus according to still another exemplary embodiment of the present invention. FIG. 17 is a diagram illustrating a lookup table of the gamma voltage generator of a present exemplary embodiment. FIG. 18 is a graph of gamma voltages as functions of grayscales illustrating the gamma voltage generator of a present exemplary embodiment.

A display apparatus and method of driving a display panel of a present exemplary embodiment are substantially the same as those of a previous exemplary embodiment shown in FIGS. 11 to 15 except for the lookup table 440 of the gamma voltage generator 400. Thus, the same reference numerals will be used to refer to the same or like parts as those described in a previous exemplary embodiment of FIGS. 11 to 15 and any repetitive explanation concerning the above elements will be omitted.

Hereinafter, referring to FIGS. 11, 16 to 18, operation of the gamma voltage generator 400 of the present invention is explained in detail.

In a present exemplary embodiment, the common voltage VCOM of the display apparatus is set to the optimal common voltage VLCOM of the low pixel. Therefore, the difference of the optimal common voltages between the high pixel and the low pixel may be compensated by decreasing the high pixel gamma voltages.

Referring to FIG. 16, high pixel positive gamma curve GCHP and high pixel negative gamma curve GCHN are curves used to decrease the high pixel gamma voltages.

High pixel positive gamma curve GCHP represents the luminances of the high pixel corresponding to positive grayscales. High pixel negative gamma curve GCHN represents the luminances of the high pixel corresponding to negative grayscales.

For example, according to grayscale G, the low pixel displays luminance LL, the high pixel displays luminance LHP which is lower than luminance LH when the data signal is positive, and the high pixel displays luminance LHN which is higher than luminance LH when the data signal is negative.

The grayscale value of the low pixel needed to display luminance LL is grayscale GL determined using gamma curve GC. The high pixel positive grayscale value needed to display luminance LHP is grayscale GHP determined using gamma curve GC. The high pixel negative grayscale value needed to display luminance LHN is grayscale GHN determined using the gamma curve GC.

High pixel positive grayscale GHP is less than high pixel grayscale GH, and high pixel negative grayscale GHN is greater than high pixel grayscale GH. Thus, high pixel positive grayscale GHP is less than high pixel negative grayscale GHN.

Referring to FIGS. 11 and 17, high pixel positive grayscale GHP, high pixel negative grayscale GHN and low pixel grayscale GL corresponding to the grayscale G are stored in the lookup table 440. For example, high pixel positive grayscale GHP1, high pixel negative grayscale GHN1 and low pixel grayscale GL1 corresponding to grayscale G1 are stored in the lookup table 440. Similarly, high pixel positive grayscale GHP2, high pixel negative grayscale GHN2 and low pixel grayscale GL2 corresponding to grayscale G2 are stored in the lookup table 440.

Referring to FIGS. 11 and 18, the gamma voltage generator 400 generates the high pixel gamma voltage and the low pixel gamma voltage using graphs P and N of the gamma voltages as functions of the grayscales.

For example, when the grayscale value of a data signal is grayscale G, the low pixel grayscale value is grayscale GL. When a positive datum is applied to the low pixel, the gamma voltage converter 450 generates low pixel gamma voltage VLP using graph P of the positive gamma voltages as functions of the grayscales. When a negative datum is applied to the low pixel, the gamma voltage converter 450 generates low pixel gamma voltage VLN using graph N of the negative gamma voltages as functions of the grayscales.

For example, when the grayscale value of a data signal is grayscale G and a positive datum is applied to the high pixel, the high pixel positive grayscale value is grayscale GHP. The gamma voltage generator 450 generates high pixel gamma voltage VHP' using graph P of the positive gamma voltages as functions of the grayscales. When the grayscale value of data signal is grayscale G and a negative datum is applied to the high pixel, the high pixel negative grayscale value is grayscale GHN. The gamma voltage generator 450 generates high pixel gamma voltage VHN' using graph N of the negative gamma voltages as functions of the grayscales.

Therefore, the high pixel positive gamma voltage VHP'-VLCOM is lower than the high pixel negative gamma voltage VLCOM-VHN' for the same grayscale.

Figure 19:
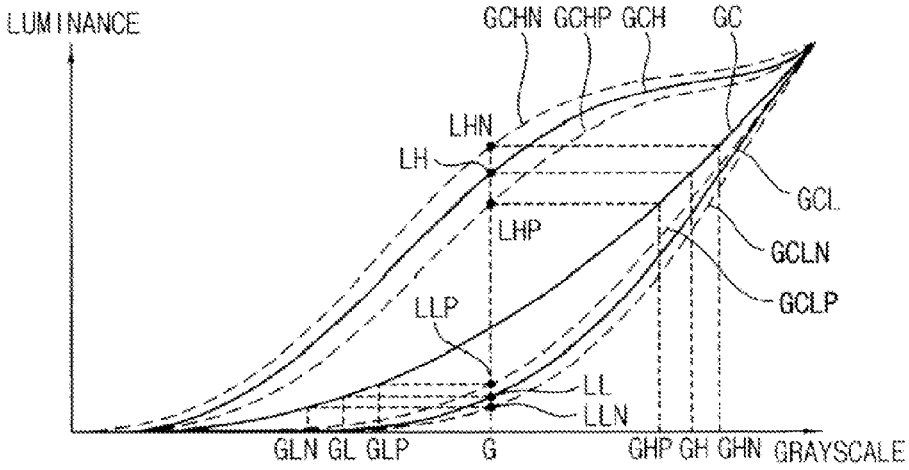
FIG. 19 is a graph of a gamma curve illustrating a gamma voltage generator of a display apparatus according to still another exemplary embodiment of the present invention.
Figures 20, 21:
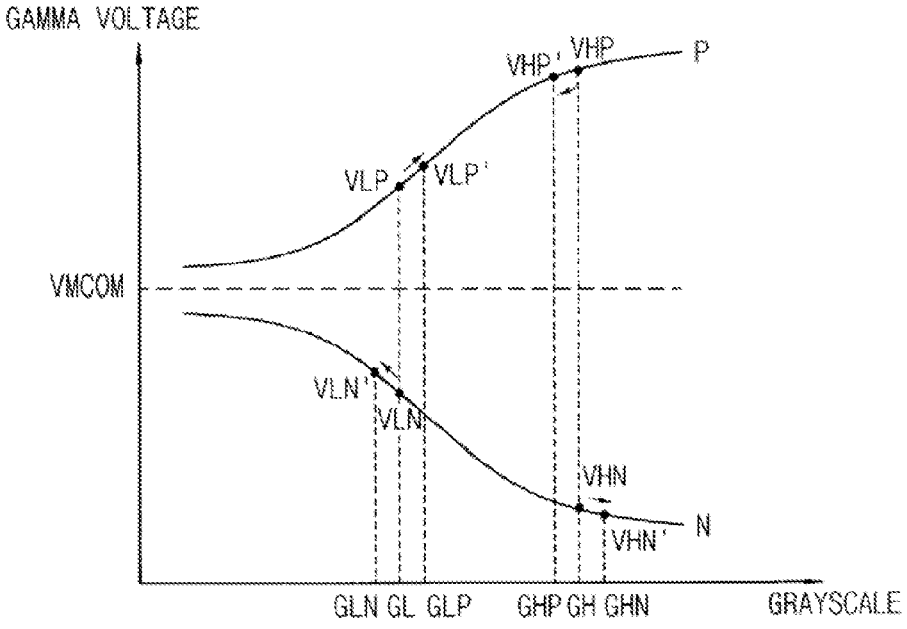
FIG. 20 is a diagram illustrating a lookup table of the gamma voltage generator of a present exemplary embodiment.
FIG. 21 is a graph of gamma voltages as functions of grayscales illustrating a gamma voltage generator of a present exemplary embodiment.

FIG. 19 is a graph of a gamma curve illustrating a gamma voltage generator of a display apparatus according to still another exemplary embodiment of the present invention. FIG. 20 is a diagram illustrating a lookup table of the gamma voltage generator of a present exemplary embodiment. FIG. 21 is a graph of gamma voltages as functions of grayscales illustrating a gamma voltage generator of a present exemplary embodiment.

A display apparatus and method of driving a display panel of a present exemplary embodiment are substantially the same as those of a previous exemplary embodiment shown in FIGS. 11 to 15 except for the lookup table 440 of the gamma voltage generator 400. Thus, the same reference numerals will be used to refer to the same or like parts as those described in a previous exemplary embodiment of FIGS. 11 to 15 and any repetitive explanation concerning the above elements will be omitted.

Hereinafter, referring to FIGS. 11, 19 to 21, operation of the gamma voltage generator 400 of a present invention is explained in detail.

In a present exemplary embodiment, the common voltage VCOM of the display apparatus is set to a value VMCOM between the optimal common voltage VHCOM of the high pixel and the optimal common voltage VLCOM of the low pixel. Therefore, the difference of the optimal common voltages between the high pixel and the low pixel may be compensated by increasing the low pixel gamma voltages and decreasing the high pixel gamma voltages.

Referring to FIG. 19, low pixel positive gamma curve GCLP and low pixel negative gamma curve GCLN are curves used to increase the low pixel gamma voltages, and high pixel positive gamma curve GCHP and high pixel negative gamma curve GCHN are curves used to decrease the high pixel gamma voltages.

Low pixel positive gamma curve GCLP represents the luminances of the low pixel corresponding to positive grayscales. Low pixel negative gamma curve GCLN represents the luminances of the low pixel corresponding to negative grayscales. High pixel positive gamma curve GCHP represents the luminances of the high pixel corresponding to positive grayscales. High pixel negative gamma curve GCHN represents the luminances of the high pixel corresponding to negative grayscales.

For example, according to grayscale G, the high pixel displays luminance LHP which is lower than luminance LH when a data signal is positive, and the high pixel displays luminance LHN which is higher than luminance LH when a data signal is negative. The low pixel displays luminance LLP which is higher than a luminance LL when the data signal is positive, and the low pixel displays luminance LLN which is lower than luminance LL when the data signal is negative.

The high pixel positive grayscale value needed to display luminance LHP is grayscale GHP determined using gamma curve GC. The high pixel negative grayscale value needed to display luminance LHN is grayscale GHN determined using gamma curve GC. The low pixel positive grayscale value needed to display luminance LLP is grayscale GLP determined using gamma curve GC. The low pixel negative grayscale value needed to display luminance LLN is grayscale GLN determined using gamma curve GC.

High pixel positive grayscale GHP is less than high pixel grayscale GH, and high pixel negative grayscale GHN is greater than high pixel grayscale GH. Thus, high pixel positive grayscale GHP is less than high pixel negative grayscale GHN.

Low pixel positive grayscale GLP is greater than low pixel grayscale GL, and low pixel negative grayscale GLN is less than low pixel grayscale GL. Thus, low pixel positive grayscale GLP is greater than low pixel negative grayscale GLN.

Referring to FIGS. 11 and 20, the high pixel positive grayscale GHP, the high pixel negative grayscale GHN, the low pixel positive grayscale GLP and the low pixel negative grayscale GLN corresponding to grayscale G are stored in the lookup table 440. For example, high pixel positive grayscale GHP1, high pixel negative grayscale GHN1, low pixel positive grayscale GLP1 and low pixel negative grayscale GLN1 corresponding to grayscale G1 are stored in the lookup table 440. Similarly, high pixel positive grayscale GHP2, high pixel negative grayscale GHN2, low pixel positive grayscale GLP2 and low pixel negative grayscale GLN2 corresponding to grayscale G2 are stored in the lookup table 440.

Referring to FIGS. 11 and 21, the gamma voltage generator 400 generates the high pixel gamma voltage and the low pixel gamma voltage using graphs P, N of the gamma voltages as functions of the grayscales.

For example, when the grayscale value of a data signal is grayscale G and a positive datum is applied to the high pixel, the high pixel positive grayscale value is grayscale GHP. The gamma voltage generator 450 generates high pixel gamma voltage VHP' using graph P of the positive gamma voltages as functions of the grayscales. When the grayscale value of a data signal is grayscale G and a negative datum is applied to the high pixel, the high pixel negative grayscale value is grayscale GHN. The gamma voltage generator 450 generates high pixel gamma voltage VHN' using graph N of the negative gamma voltages as functions of the grayscales.

For example, when the grayscale value of a data signal is grayscale G and a positive datum is applied to the low pixel, the low pixel positive grayscale value is grayscale GLP. The gamma voltage generator 450 generates low pixel gamma voltage VLP' using graph P of the positive gamma voltages as functions of the grayscales. When the grayscale value of data signal is grayscale G and a negative datum is applied to the low pixel, the low pixel negative grayscale value is grayscale GLN. The gamma voltage generator 450 generates low pixel gamma voltage VLN' using graph N of the negative gamma voltages as functions of the grayscales.

Therefore, high pixel positive gamma voltage VHP'-VMCOM is lower than high pixel negative gamma voltage VMCOM-VHN' for the same grayscale. In addition, low pixel positive gamma voltage VLP'-VMCOM is higher than low pixel negative gamma voltage VMCOM-VLN' for the same grayscale.

According to a present exemplary embodiment, the difference of the optimal common voltages between the high pixel and the low pixel may be compensated to reduce the afterimage.

The foregoing is illustrative of embodiments of the present invention and is not to be construed as limiting thereof. Although a few exemplary embodiments of the present invention have been described, those skilled in the art will readily appreciate that many modifications are possible in the exemplary embodiments without materially departing from the novel teachings of the present invention. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A method of driving a display panel, the method comprising:

generating a high pixel gamma voltage and a low pixel gamma voltage, including converting a grayscale of a data signal into a high pixel grayscale and a low pixel grayscale using a lookup table that includes information on the high pixel grayscale and the low pixel grayscale corresponding to the grayscale of the data signal, wherein at least one of said high pixel grayscale and said low pixel grayscale has a positive grayscale and a negative grayscale, wherein at least one of said high pixel gamma voltage and said low pixel gamma voltage has a positive gamma voltage and a negative gamma voltage having different values for the same grayscale, the positive gamma voltage being a difference between a first gamma voltage higher than a common voltage and the common voltage, the negative gamma voltage being a difference between the common voltage and a second gamma voltage lower than the common voltage, and wherein the common voltage is set to an optimal common voltage of the low pixel, the lookup table includes information on a high pixel positive grayscale, a high pixel negative grayscale and the low pixel grayscale, and the high pixel positive grayscale is less than the high pixel negative grayscale; and generating a high pixel data voltage based on the high pixel gamma voltage;

outputting the high pixel data voltage to a high pixel;

generating a low pixel data voltage based on the low pixel gamma voltage, and outputting the low pixel data voltage to a low pixel.

2. A display apparatus comprising:

a display panel including a unit pixel having a high pixel and a low pixel, the high pixel being electrically connected to a first gate line and a first data line, the low pixel being electrically connected to the first gate line and a second data line adjacent and parallel to the first data line;

a gamma voltage generator generating a high pixel gamma voltage and a low pixel gamma voltage wherein at least one of said high pixel gamma voltage and said low pixel gamma voltage has a positive gamma voltage and a negative gamma voltage having different values for the same grayscale, the positive gamma voltage being a difference between a first gamma voltage higher than a common voltage and the common voltage, the negative gamma voltage being a difference between the common voltage and a second gamma voltage lower than the common voltage, and wherein the gamma voltage generator comprises a lookup table that includes information on a high pixel grayscale and a low pixel grayscale corresponding to a grayscale of a data signal, and at least one of said high pixel grayscale and said low pixel grayscale has a positive grayscale and a negative grayscale; and a data driver that generates a high pixel data voltage based on the high pixel gamma voltage and outputs the high pixel data voltage to the first data line, and generates a low pixel data voltage based on the low pixel gamma voltage and outputs the low pixel data voltage to the second data line, wherein the common voltage is set to a value between an optimal common voltage of the high pixel and an optimal common voltage of the low pixel, the lookup table includes information on a high pixel positive grayscale, a high pixel negative grayscale, a low pixel positive grayscale and a low pixel negative grayscale, the low pixel positive grayscale is greater than the low pixel negative grayscale, and the high pixel positive grayscale is less than the high pixel negative grayscale.

* * * * *